US005384960A

United States Patent [19]

Tottenham

[11] Patent Number: 5,384,960

[45] Date of Patent: Jan. 31, 1995

[54] NAIL CLIPPER

[76] Inventor: John E. Tottenham, 72 Walnut St., Seymour, Conn. 06483

[21] Appl. No.: 214,461

[22] Filed: Mar. 18, 1994

[51] Int. Cl.[6] ..... A45D 29/00

[52] U.S. Cl. ..... 30/28; 132/75.5

[58] Field of Search ..... 30/26, 27, 28, 29; 132/75.3, 75.4, 75.5

[56] References Cited

U.S. PATENT DOCUMENTS

| | | | |
|---|---|---|---|
| 244,891 | 7/1881 | Heim et al. | 30/28 |
| 569,903 | 10/1896 | Wenger . | |
| 612,990 | 10/1898 | Kiefaber | 30/28 |
| 970,067 | 9/1910 | Leineweber | 30/29 |
| 1,394,727 | 10/1921 | Gronbech . | |
| 2,422,207 | 5/1945 | Nalpantian . | |
| 3,888,006 | 6/1975 | Roberts . | |
| 3,997,966 | 12/1976 | Sartore | 30/28 |
| 4,196,514 | 4/1980 | Merriman | 30/28 |
| 4,637,137 | 1/1987 | Husain . | |

*Primary Examiner*—Richard K. Seidel
*Assistant Examiner*—Hwei-Siu Payer
*Attorney, Agent, or Firm*—Bachman & LaPointe

[57] ABSTRACT

The present invention relates to an improved nail clipper having ring members for accommodating the thumb and a finger of a user or alternatively two fingers of a user so that the user can obtain a firm grasp of the nail clipper during use thereof. The ring members are movably mounted to the nail clipper so as to allow them to assume a variety of different positions relative thereto. Preferably, the ring members are mounted to the nail clipper by rotatable pin members, each having a groove machined therein for receiving a respective ring member.

9 Claims, 1 Drawing Sheet

NAIL CLIPPER

BACKGROUND OF THE INVENTION

The present invention relates to an improved nail clipper having movably mounted ring members into which the forefinger and the thumb or two fingers of a user may be inserted to allow a firmer grip on the clipper during use.

The basic construction of a nail clipper has not changed much over the years. U.S. Pat. Nos. 569,903 to Wenger and U.S. Pat. No. 1,394,727 to Gronbech illustrate some of the older types of nail clippers. As shown in these patents, nail clippers typically have first and second members joined to each other at one end. The first and second members each include a jaw portion at a second end opposed to said one end. The nail clippers typically include an operating lever for moving the jaw portions of the first and second members from an open position to a cutting position. U.S. Pat. No. 4,637,137 to Husain illustrates a newer version of a nail clipper also having first and second members that are joined together at one end, which members include jaw portions at the opposite end, and an operating lever for moving the jaws into a nail cutting position.

In some of these older constructions, a pivotable member is provided to lock the operating lever in a fixed position relative to the first and second members. In the Wenger patent, the pivotable member comprises a ring member mounted into side walls of the nail clipper. The ring member maintains the operating lever in a fixed position by engaging a notch therein. U.S. Pat. No. 612,990 to Kiefaber illustrates a similar arrangement where a rectangularly shaped member engages the tip of an operating lever.

It is known in the art to provide cutting implements with finger grips for allowing a user to more firmly grasp the implement. U.S. Pat. No. 2,422,207 to Nalpantian for example illustrates a manicuring implement having rings into which the fingers of a user may be inserted. U.S. Pat. No. 3,888,006 to Roberts illustrates a device for clipping the stems of fruit and the like having partially circular members mounted to the device for receiving the thumb and forefinger of an operator's hand.

U.S. Pat. No. 3,997,966 to Sartore illustrates a nail clipper having upper and lower handles in the nature of scissor handles for facilitating holding the nail clipper and maintaining it in a desired position.

The principal difficulty with the finger retaining means known in the prior art is that they are non-movable and fixed in position with respect to the various components of the clipper. As a result, it can be difficult to properly position the clipper so as to cut a nail without inflicting any injury on the user. This is particularly true when the user is attempting to cut a toe nail.

The nail clipper of the present invention successfully overcomes this problem.

SUMMARY OF THE INVENTION

Accordingly, it is an object of the present invention to provide an improved nail clipper having movable and means for receiving parts of a human hand and for allowing a user to more firmly grasp the nail clipper.

It is a further object of the present invention to provide a nail clipper as above wherein the receiving means can be moved to a variety of positions to accommodate the user.

It is yet a further object of the present invention to provide an improved nail clipper as above wherein the receiving means can be moved to a compact storage position.

It is still a further object of the present invention to provide an improved nail clipper as above wherein one of the receiving means can also function as a locking mechanism.

Still other objects of and advantages to the nail clipper of the present invention will become more apparent from the following description and the accompanying drawings wherein like reference numerals depict like elements.

The foregoing objects of the present invention are achieved by the nail clipper of the present invention which comprises first and second members having jaw portions located adjacent one end of the members with the members having a normal position wherein the jaw portions are spaced apart. The nail clipper further comprises first means, such as a pin member, for connecting the first and second members, operating means for moving the jaw portions from the normal position to a cutting or trimming position wherein the jaw portions can cut or trim a nail inserted between the jaw portions, and means for receiving parts of a human hand, such as two fingers of either hand or a finger and thumb from either hand, movably fixed to the operating means and to the first means.

The receiving means preferably comprise two ring members. One ring member is preferably mounted to the operating means by a rotatable pin having a groove into which a portion of the ring member is inserted. This type of mounting arrangement is advantageous for several reasons. First, the ring member may be rotated with respect to a longitudinal axis of the operating means as a result of being mounted to a rotatable pin. This is desirable from the standpoint of accommodating correct positioning of the nail clipper. Second, the ring member may be rotated to a storage position wherein it lies adjacent a surface of the operating means.

The second ring is preferably inserted into a groove in the first means which is preferably a rotatable pin member. As a result, this ring is capable of being rotated with respect to a longitudinal axis of the nail clipper. As before this is desirable from the standpoint of accommodating correct positioning of the nail clipper, particularly when the clipper is being to cut toe nails. This mounting arrangement also allows the second ring to be rotated to a position wherein it overlaps the operating means and the first and second members so as to hold the nail clipper in a locked position.

The ring members of the present invention clearly provide an improved ability to grasp the nail clipper so as to avoid injury to the user. The ring members also allow the nail clipper to be placed in a variety of different operating positions relative to the user and a nail to be trimmed or cut.

Still other features of the present invention are set out in the following description and the accompanying drawings.

DETAILED DESCRIPTION

Figure 1:
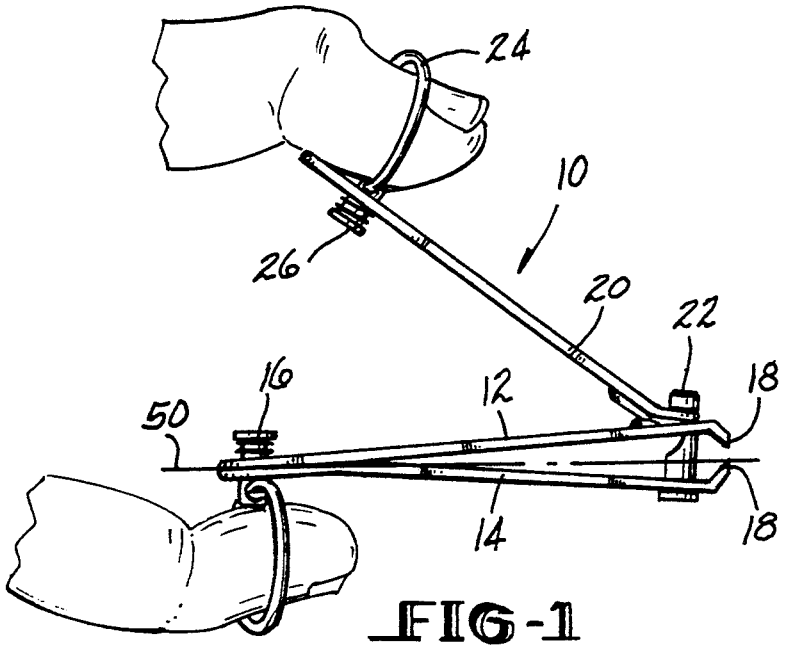
FIG. 1 is a perspective view illustrating the nail clipper of the present invention in its operational position.

Referring now to the drawings, FIG. 1 illustrates a nail clipper 10 which embodies the present invention. The nail clipper 10 has a first member 12 and a second member 14 connected together at a first end by a pin member 16 which passes through a bore or hole (not shown) in each of the first and second members. The pin member 16 is sized so that it can rotate within the bore. If desired, further means such as an adhesive or a weld may be used to join the first and second members together at the first end. Each of the members 12 and 14 has a jaw portion 18 at a second end opposed to the first end. The members are such that the jaw portions 18 are normally in a spaced apart relationship.

Figure 5:
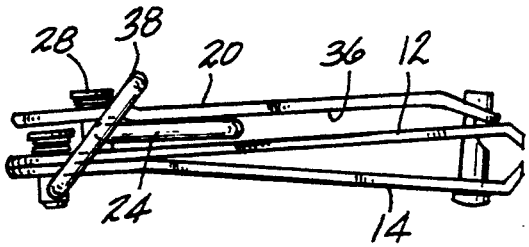
FIG. 5 is a perspective view illustrating the nail clipper of the present invention in a stored position.

The nail clipper further includes an operating lever 20 connected to a bolt or pin member 22 which extends through a second set of bores or holes (not shown) in the first and second members. The operating lever 20 is connected to the pin member 22 so that it can be rotated between the operating position shown in FIG. 1 and the retracted position shown in FIG. 5. In the operating position, the lever 20 contacts a surface of the member 12 and is capable of causing the jaw portions to move to an operational position wherein a nail inserted between the jaw portions may be cut or trimmed.

Figure 2:
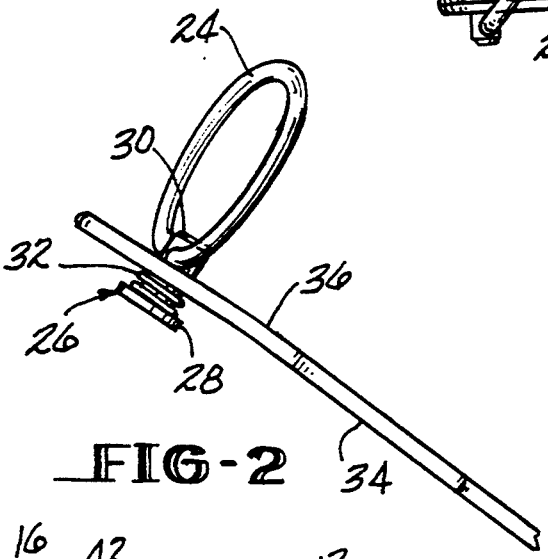
FIG. 2 is an enlarged view of a first one of the ring members of the present invention illustrating the manner in which it is mounted to an operating lever.

As shown in FIG. 2, a first ring member 24 is mounted to the operating lever 20. The mounting arrangement comprises a pin member 26 which passes through a bore or hole in the operating lever. Preferably, the bore or hole has a diameter larger than the diameter of the pin portion passing therethrough. As a result, the pin member 26 is free to rotate within the bore or hole.

Figure 3:
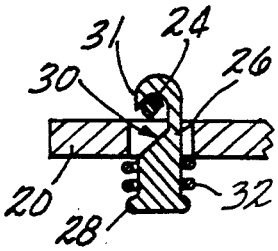
FIG. 3 is a sectional view of a pin member used to mount the ring member of FIG. 2 to the operating lever.

The pin member 26 has an enlarged head portion 28 and a groove 30 machined therein into which a portion of the ring member 24 is inserted. The groove 30 is illustrated in FIG. 3. As shown therein, it has an arcuate configuration for receiving a portion of the ring member 24 and an overlapping tip portion 31 for contacting a portion of the ring member 24 and retaining it within the groove 30. A spring 32 is provided between the head portion 28 of the pin and a surface 34 of the operating lever 20 to retain the ring member 24 within the groove 30.

As a result of this mounting arrangement, the ring member 24 is pivotable or swivellable with respect to the longitudinal axis of the operating lever. This enables the ring member 24 to be adjusted to a number of different positions with respect to the user and the nail which is being cut. The ring member 24 is also rotatable about an axis which is substantially transverse to a longitudinal axis of the pin member 26. As a consequence, the ring member may be moved into a storage or retracted position wherein it lies adjacent the surface 36 of the operating lever. The ring member 24 is preferably sized so as to accommodate either a finger or a thumb of either hand of a user between the inner periphery of the ring member 24 and the flattened or rounded tip of the pin member 26.

Figure 4:
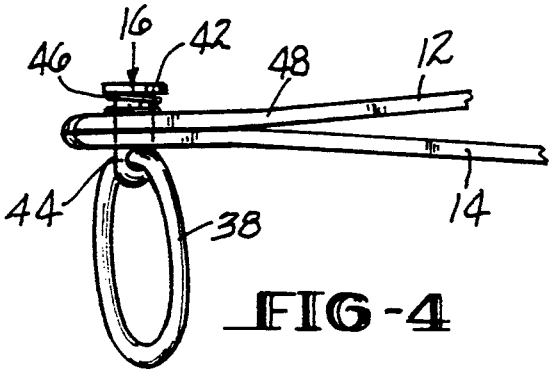
FIG. 4 is an enlarged view of a second one of the ring members of the present invention illustrating the manner in which it is mounted to the first and second members by a pin member.

As shown in FIG. 4, a second ring member 38 is mounted to the pin member 16. The pin member 16 has a construction identical to the pin member 26. It includes an enlarged head portion 42 and a groove 44 machined therein. As before, the ring member 38 is inserted into the groove 44. Spring 46 is positioned between the enlarged head portion 42 and a surface 48 of member 12 to retain the ring member 38 within the groove 44.

The ring member 38 is rotatable with respect to the longitudinal axis 50 of the nail clipper due to the fact that the pin member 16 is rotatable. The ring member 38 is also rotatable about an axis substantially transverse to the longitudinal axis of the pin member 16 because of the mounting of the ring member 38 within the groove 44. As a result, the ring member may be moved between the operational position shown in FIG. 1 and the locking position shown in FIG. 5. In the locking position, the ring member 38 overlaps the first and second members 12 and 14, the operating lever 20 and the enlarged head portion 28 of the pin member 26. This effectively locks the nail clipper so that the jaws cannot be moved relative to each other and into the nail cutting or trimming position. This also allows the nail clipper to assume a compact configuration for storage. If desired, the ring member 38 may be stored in an alternative position where it lies adjacent a surface of the member 14.

The ring member 38 is sized so as to accommodate either the thumb or finger of either hand of a user between the inner periphery of the ring member and the flattened or rounded tip portion of the pin member 16.

The ring members 24 and 38 provide a user of the nail clipper 10 with the ability to firmly grasp the nail clipper so that it does not slip during use and injure the user. This is particularly significant when the clipper is being used to cut a toe nail. The movably mounted ring members 24 and 38 further allow the user to position the nail clipper as needed in a comfortable position. Still further, the ring member 38 allows the nail clipper to be locked into a compact storage configuration wherein the jaw members can not be moved relative to each other. Yet another advantage to the nail clipper of the present invention is that it may be used with either hand.

The mounting arrangement used to mount the ring members 24 and 38 to the nail clipper allows them to be easily assembled to and disassembled from the nail clipper 10. Disassembly of a ring member 24 or 38 is accomplished by pushing the enlarged head portion of the respective pin member 26 or 16, against the pressure of the respective spring 32 or 46 associated therewith, towards either the first and second members 12 and 14 or the operating lever 20. This causes a portion of the groove 30 or 44 which ordinarily resides within the bore or hole in either the first and second members or the operating lever to extend above the surface of the first and second members or the operating lever and thereby release the ring member for removal. Assembly of the ring members onto the nail clipper is achieved by pushing the enlarged head portion so that the groove is completely exposed and inserting the respective ring member into the exposed groove.

The nail clipper of the present invention may be used to cut or trim nails on a human being or on another living being such as an animal.

It is apparent that there has been provided in accordance with this invention a nail clipper which fully satisfies the objects, means, and advantages et forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A nail clipper for cutting nails on a living being comprising:

first and second members each having a jaw portion located adjacent one end thereof, said members having a normal position wherein said jaw portions are spaced apart;

first means for connecting said first and second members;

operating means for moving said jaw portions from said normal position to a position wherein said jaw portions can cut a nail inserted between said jaw portions;

means for receiving parts of a human hand movably fixed to said operating means and to said first means to facilitate use of said clipper and to allow the clipper to be firmly grasped;

said receiving means comprising ring members affixed to said first means and said operating means; and one of said ring members being mounted to said operating means by a rotatable pin, said rotatable pin enabling said one ring member to be moved relative to a longitudinal axis of said operating means.

2. The nail clipper of claim 1 wherein said rotatable pin has a groove for receiving said one ring member and means for retaining said one ring member within said groove, said one ring member when seated in said groove being free to rotate about an axis which is substantially transverse to a longitudinal axis of said pin.

3. The nail clipper of claim 2 wherein said rotatable pin has an enlarged head portion and said retaining means comprises a spring positioned between said enlarged head portion and a surface of said operating means.

4. A nail clipper for cutting nails on a living being comprising:

first and second members each having a jaw portion located adjacent one end thereof, said members having a normal position wherein said jaw portions are spaced apart;

first means for connecting said first and second members;

operating means for moving said jaw portions from said normal position to a position wherein said jaw portions can cut a nail inserted between said jaw portions;

means for receiving parts of a human hand movably fixed to said operating means and to said first means to facilitate use of said clipper and to allow the clipper to be firmly grasped;

said receiving means comprising ring members affixed to said first means and said operating means;

said first means comprising a bore which passes through said first and second members and which is located at a position remote from said jaw portions; and a pin rotatably mounted within said bore.

5. The nail clipper of claim 4 wherein said rotatable pin has a groove for receiving one of said ring members, said one ring member being rotatable relative to said first and second members and to a longitudinal axis of said nail clipper.

6. The nail clipper of claim 5 wherein said one ring member is further rotatable about an axis substantially transverse to a longitudinal axis of said pin and is thereby capable of being rotated to a position wherein a portion of said one ring member extends over said first and second members and said operating means.

7. The nail clipper of claim 5 further comprising means for retaining said one ring member within said groove.

8. The nail clipper of claim 7 wherein said pin has a head portion and said retaining means comprises a spring positioned between said head portion and one of said first and second members.

9. An improved nail clipper for cutting nails on a human being, said nail clipper comprising:

first and second members joined together at one end by a first pin member and each having a jaw portion at a second end, said jaw portions having a normal position wherein they are spaced apart;

an operating lever contacting one of said first and second members for moving the jaw portion of said one member from said normal position to a cutting position;

said operating lever being rotatable about a bolt which passes through both said first and second members;

a first ring member affixed to said operating lever by a rotatable second pin member, said first ring member being movable between an operational position wherein at least one of a first finger and a thumb may be inserted within said first ring member and a retracted position wherein said first ring member lies adjacent a surface of said operating lever; and a second ring member affixed to said first and second members by said first pin member, said second ring member being rotatable relative to said first and second members and being movable between an operational position wherein at least one of a second finger and said thumb may be inserted within said second ring member and a locking position wherein said second ring member overlies said first and second members and said operating lever.

* * * * *